US009515439B2

(12) United States Patent
Ng et al.

(10) Patent No.: US 9,515,439 B2
(45) Date of Patent: Dec. 6, 2016

(54) CONNECTOR INSERT ASSEMBLY

(71) Applicant: Apple Inc., Cupertino, CA (US)

(72) Inventors: Nathan N. Ng, Fremont, CA (US); Zheng Gao, San Jose, CA (US); Mahmoud R. Amini, Sunnyvale, CA (US); Min Chul Kim, Santa Clara, CA (US); Colin J. Abraham, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/641,375

(22) Filed: Mar. 7, 2015

(65) Prior Publication Data

US 2015/0340825 A1 Nov. 26, 2015

Related U.S. Application Data

(63) Continuation-in-part of application No. 14/543,803, filed on Nov. 17, 2014.

(60) Provisional application No. 62/003,012, filed on May 26, 2014.

(51) Int. Cl.

| | |
|---|---|
| ***H01R 13/648*** | (2006.01) |
| ***H01R 24/70*** | (2011.01) |
| ***H01R 43/16*** | (2006.01) |
| ***H01R 13/6581*** | (2011.01) |
| ***H01R 13/6585*** | (2011.01) |
| ***H01R 13/6597*** | (2011.01) |
| *H01R 13/24* | (2006.01) |

(Continued)

(52) U.S. Cl.

CPC ..... *H01R 24/70* (2013.01); *H01R 13/6581* (2013.01); *H01R 13/6585* (2013.01); *H01R 13/6597* (2013.01); *H01R 43/16* (2013.01); *H01R 13/2442* (2013.01); *H01R 13/6275* (2013.01); *H01R 24/64* (2013.01); *Y10T 29/4921* (2015.01)

(58) Field of Classification Search

CPC . H01R 13/65802; H01R 13/685; H01R 13/74; H01R 23/6873; H01R 23/7073

USPC ..... 439/607.28, 541.5

See application file for complete search history.

(56) References Cited

U.S. PATENT DOCUMENTS

| | | | |
|---|---|---|---|
| 3,128,138 | A | 4/1964 | Noschese |
| 3,587,029 | A | 6/1971 | Knowles |
| 4,337,989 | A | 7/1982 | Asick et al. |

(Continued)

FOREIGN PATENT DOCUMENTS

| | | |
|---|---|---|
| CN | 101882726 | 11/2010 |
| CN | 101908679 | 12/2010 |

(Continued)

OTHER PUBLICATIONS

Office Action mailed on Nov. 17, 2015 for U.S. Appl. No. 14/543,748, 21 pages.

(Continued)

*Primary Examiner* — Abdullah Riyami
*Assistant Examiner* — Vladimir Imas
(74) *Attorney, Agent, or Firm* — Kilpatrick Townsend & Stockton LLP

(57) ABSTRACT

Connector inserts having retention features with good reliability and holding force. These connector inserts may include ground contacts that provide an insertion portion having a reduced length. These connector inserts may be reliable, have an attractive appearance, and be readily manufactured.

20 Claims, 18 Drawing Sheets

(51) Int. Cl.
*H01R 13/627* (2006.01)
*H01R 24/64* (2011.01)

(56) References Cited

U.S. PATENT DOCUMENTS 4,389,080 A 6/1983 Clark et al.
4,544,227 A 10/1985 Hirose
4,571,012 A * 2/1986 Bassler ..... H01R 13/65802 439/101
4,684,192 A 8/1987 Long et al.
4,808,118 A 2/1989 Wilson et al.
4,875,881 A 10/1989 Caveny et al.
4,950,184 A 8/1990 Caveney et al.
5,037,315 A 8/1991 Collier et al.
5,145,385 A 9/1992 Takano
5,164,880 A 11/1992 Cronin et al.
5,221,212 A * 6/1993 Davis ..... H01R 23/6873 439/108
5,318,452 A * 6/1994 Brennian, Jr. ..... G06K 7/0047 439/541.5
5,382,179 A 1/1995 Noschese
5,431,578 A 7/1995 Wayne
5,586,911 A 12/1996 Miller
5,591,050 A * 1/1997 Sueoka ..... H01R 23/6873 439/607.28
5,622,522 A * 4/1997 Tan ..... H01R 12/7052 439/607.28
5,674,085 A * 10/1997 Davis ..... H01R 13/7031 200/51.1
5,788,516 A 8/1998 Uggmark
5,913,690 A 6/1999 Dechelette et al.
5,975,935 A 11/1999 Yamaguchi et al.
5,997,349 A 12/1999 Yoshioka
6,019,616 A 2/2000 Yagi et al.
6,039,583 A 3/2000 Korsunsky et al.
6,042,424 A 3/2000 LaCoy et al.
6,162,089 A * 12/2000 Costello ..... H01R 23/6873 29/832
6,203,333 B1 3/2001 Medina et al.
6,287,147 B1 9/2001 Lin
6,338,652 B1 1/2002 Ko
6,447,311 B1 * 9/2002 Hu ..... H01R 23/6873 439/108
6,565,366 B1 5/2003 Wu
6,685,486 B1 * 2/2004 Zhang ..... H01R 13/6215 439/79
6,736,676 B2 * 5/2004 Zhang ..... H01R 12/727 439/541.5
6,755,689 B2 * 6/2004 Zhang ..... H01R 12/716 439/357
6,840,806 B2 * 1/2005 Kodama ..... H01R 13/6271 439/607.24
6,913,485 B2 * 7/2005 Ko ..... H01R 9/035 439/579
6,926,557 B1 * 8/2005 Yamaguchi ..... H01R 12/7064 439/607.54
6,981,887 B1 1/2006 Mese et al.
7,052,287 B1 * 5/2006 Ni ..... G06K 19/07732 439/660
7,074,052 B1 * 7/2006 Ni ..... H01R 13/6658 174/261
7,086,889 B2 * 8/2006 Yin ..... H01R 13/6395 439/358
7,086,901 B2 * 8/2006 Zhang ..... H01R 12/716 439/541.5
7,094,103 B2 * 8/2006 Lai ..... H01R 9/032 439/607.45
7,128,588 B2 * 10/2006 Hu ..... H01R 13/6275 439/159
7,179,124 B2 2/2007 Zhang et al.
7,207,836 B2 * 4/2007 Tsai ..... H01R 13/5804 439/541.5
7,269,004 B1 * 9/2007 Ni ..... H05K 5/0278 361/679.41
7,314,383 B1 * 1/2008 Ho ..... H01R 13/506 439/353
7,364,464 B2 * 4/2008 Iino ..... H01R 12/716 439/607.55
7,407,390 B1 * 8/2008 Ni ..... G06K 19/07732 361/752
7,445,452 B1 * 11/2008 Wu ..... H01R 13/6205 439/39
7,462,071 B1 12/2008 Wu
7,466,556 B2 * 12/2008 Hiew ..... G06F 12/1416 361/736
7,497,737 B2 * 3/2009 Mikolajczak ..... H01R 13/6666 439/620.29
7,604,497 B2 * 10/2009 Wu ..... H01R 13/6275 439/358
7,658,617 B1 2/2010 Brodsky et al.
7,670,156 B2 3/2010 Chen
7,686,656 B2 * 3/2010 Zheng ..... H01R 23/6873 439/660
7,699,663 B1 * 4/2010 Little ..... H01R 13/65802 439/660
7,753,724 B2 * 7/2010 Gong ..... H01R 12/58 439/541.5
7,837,506 B1 11/2010 Chiang
7,837,510 B1 * 11/2010 Hung ..... H01R 13/41 439/660
7,841,905 B2 * 11/2010 Zheng ..... H01R 23/6873 439/660
7,878,852 B2 * 2/2011 Hiew ..... G06K 19/077 439/607.01
7,883,369 B1 2/2011 Sun et al.
7,997,909 B2 8/2011 Xu et al.
8,011,948 B2 9/2011 Wu
8,011,950 B2 9/2011 McGrath et al.
8,011,968 B2 * 9/2011 Lai ..... H01R 13/65802 439/660
8,047,875 B2 11/2011 Yamakami et al.
8,052,476 B2 * 11/2011 Zheng ..... H01R 24/62 439/660
8,100,720 B2 * 1/2012 Lin ..... H01R 27/00 439/607.34
8,133,061 B1 3/2012 Ayers, Sr. et al.
8,147,272 B2 4/2012 Rhein
8,251,747 B2 * 8/2012 He ..... H01R 13/65802 439/607.28
8,298,009 B2 10/2012 Elkhatib et al.
8,393,907 B2 3/2013 Lee et al.
8,454,381 B2 6/2013 Wu
8,475,218 B2 * 7/2013 Zheng ..... G02B 6/3817 439/660
8,476,110 B2 7/2013 Lee et al.
8,506,317 B2 * 8/2013 Lim ..... H01R 9/032 439/345
8,545,273 B1 10/2013 Chen
8,567,050 B2 10/2013 Hiew et al.
8,579,519 B2 * 11/2013 Wu ..... G02B 6/3817 385/101
8,602,822 B2 12/2013 Siahaan et al.
8,662,933 B2 * 3/2014 Wu ..... H01R 13/6585 439/660
8,696,388 B2 4/2014 Gao et al.
8,708,718 B2 * 4/2014 Li ..... H01R 4/027 439/108
8,708,752 B2 4/2014 Wu
8,747,147 B2 * 6/2014 Yu ..... H01R 13/7031 439/108
8,764,492 B2 * 7/2014 Chiang ..... H01R 13/05 439/676
8,794,981 B1 8/2014 Hayashida et al.
8,808,029 B2 8/2014 Castillo et al.
8,808,030 B2 8/2014 Gao et al.
8,814,443 B2 * 8/2014 He ..... G02B 6/3817 385/49
8,814,599 B2 * 8/2014 Wu ..... H01R 13/5808 439/607.48
8,821,181 B1 9/2014 Lam et al.
8,911,262 B1 12/2014 Leiba et al.

(56) References Cited

U.S. PATENT DOCUMENTS

| | | | | |
|---|---|---|---|---|
| 8,992,249 | B2 | 3/2015 | Kobayashi et al. | |
| 9,065,212 | B2 | 6/2015 | Golko et al. | |
| 9,065,229 | B2 | 6/2015 | Yamaguchi et al. | |
| 9,276,340 | B2 | 3/2016 | Amini et al. | |
| 9,356,370 | B2 | 5/2016 | Lee et al. | |
| 2002/0001982 | A1 | 1/2002 | Sakurada | |
| 2002/0142636 | A1 | 10/2002 | Murr et al. | |
| 2005/0026469 | A1 | 2/2005 | Ice et al. | |
| 2006/0052005 | A1 | 3/2006 | Zhang et al. | |
| 2007/0072446 | A1 | 3/2007 | Hashimoto et al. | |
| 2007/0111600 | A1 | 5/2007 | Tokunaga | |
| 2007/0115682 | A1 | 5/2007 | Roberts et al. | |
| 2007/0254517 | A1 | 11/2007 | Olson et al. | |
| 2009/0023339 | A1 | 1/2009 | Kameyama et al. | |
| 2009/0042448 | A1 | 2/2009 | He et al. | |
| 2010/0248544 | A1 | 9/2010 | Xu et al. | |
| 2010/0267282 | A1 | 10/2010 | Tsai | |
| 2010/0303421 | A1 | 12/2010 | He et al. | |
| 2011/0151688 | A1 | 6/2011 | Beaman | |
| 2011/0237134 | A1 | 9/2011 | Gao et al. | |
| 2011/0300749 | A1 | 12/2011 | Sytsma et al. | |
| 2012/0015561 | A1 | 1/2012 | Tsai | |
| 2012/0030943 | A1 | 2/2012 | Hiew et al. | |
| 2012/0282808 | A1 | 11/2012 | Luo | |
| 2013/0005193 | A1 | 1/2013 | Tsai | |
| 2013/0045638 | A1 | 2/2013 | Gui et al. | |
| 2013/0122752 | A1 | 5/2013 | Lu | |
| 2013/0164965 | A1 | 6/2013 | Yin et al. | |
| 2013/0183862 | A1 | 7/2013 | Ni et al. | |
| 2013/0217253 | A1 | 8/2013 | Golko et al. | |
| 2013/0244492 | A1 | 9/2013 | Golko et al. | |
| 2013/0288520 | A1 | 10/2013 | Simmel | |
| 2013/0288537 | A1* | 10/2013 | Simmel | H01R 13/6583 439/660 |
| 2013/0330976 | A1* | 12/2013 | Simmel | H01R 13/659 439/660 |
| 2014/0024257 | A1 | 1/2014 | Castillo et al. | |
| 2014/0073183 | A1 | 3/2014 | Golko | |
| 2014/0078695 | A1 | 3/2014 | Shih et al. | |
| 2014/0094066 | A1 | 4/2014 | Do | |
| 2014/0113493 | A1 | 4/2014 | Funamura | |
| 2014/0194005 | A1 | 7/2014 | Little | |
| 2014/0220827 | A1 | 8/2014 | Hsu | |
| 2014/0242848 | A1 | 8/2014 | Golko et al. | |
| 2015/0031240 | A1 | 1/2015 | Yang | |
| 2015/0131245 | A1 | 5/2015 | Amini et al. | |
| 2015/0162684 | A1 | 6/2015 | Amini et al. | |
| 2015/0171562 | A1 | 6/2015 | Gao et al. | |
| 2015/0200493 | A1 | 7/2015 | Gao et al. | |
| 2015/0214673 | A1 | 7/2015 | Gao et al. | |
| 2015/0340782 | A1 | 11/2015 | Amini et al. | |
| 2015/0340783 | A1 | 11/2015 | Lee et al. | |
| 2015/0340813 | A1 | 11/2015 | Ng et al. | |

FOREIGN PATENT DOCUMENTS

| | | | |
|---|---|---|---|
| CN | 102341970 | | 2/2012 |
| CN | 103140995 | | 6/2013 |
| EP | 1 085 604 | A2 | 3/2001 |
| EP | 2 228 871 | A2 | 9/2010 |
| EP | 2 590 273 | A2 | 5/2013 |
| GB | 2 067 361 | A | 7/1981 |
| WO | 2011/163256 | A1 | 12/2011 |
| WO | 2012/177905 | A2 | 12/2012 |

OTHER PUBLICATIONS

Office Action mailed on Dec. 9, 2015 for U.S. Appl. No. 14/543,711, 15 pages.

Office Action mailed on Jan. 4, 2016 for U.S. Appl. No. 14/543,803, 14 pages.

Notice of Allowance mailed on Jan. 25, 2016, for U.S. Appl. No. 14/641,353, 8 pages.

Taiwan Office Action mailed on Nov. 23, 2015 for Taiwan U.S. Appl. No. 14/543,748, 7 pages.

International Search Report and Written Opinion of the International Seaching Authority mailed on Mar. 17, 2015 for PCT Patent Application No. PCT/US2015/010253, 12 pages.

Invitation to Pay Additional Fees and, Where Applicable, Protest Fee with Partial International Search Report mailed on Apr. 28, 2015 for PCT Patent Application No. PCT/US2014/065968, 6 pages.

Invitation to Pay Additional Fees and, Where Applicable, Protest Fee with Partial International Search Report mailed on May 4, 2015 for PCT Patent Application No. PCT/US2014/065996, 7 pages.

International Search Report and Written Opinion of the International Seaching Authority mailed on Jul. 3, 2015 for PCT Patent Application No. PCT/US2014/065968, 17 pages.

International Search Report and Written Opinion of the International Seaching Authority mailed on Jul. 10, 2015 for PCT Patent Application No. PCT/US2014/065996, 18 pages.

Notice of Allowance mailed on Oct. 14, 2015 for U.S. Appl. No. 14/543,768, 9 pages.

Office Action mailed on Nov. 10, 2015 for U.S. Appl. No. 14/543,717, 16 pages.

Final Office Action mailed on Mar. 28, 2016 for U.S. Appl. No. 14/543,711, 9 pages.

Notice of Allowance, U.S. Appl. No. 14/543,717, dated May 25, 2016, 8 pages.

Final Office Action, U.S. Appl. No. 14/543,748, dated Jun. 28, 2016, 21 pages.

Notice of Allowance, U.S. Appl. No. 14/543,803, dated Jun. 27, 2016, 7 pages.

Restriction Requirement, U.S. Appl. No. 14/543,803, Oct. 8, 2015, 5 pages.

Office Action, Chinese Patent Application No. 201410858208.7, dated Jul. 4, 2016, 19 pages.

Office Action, Chinese Patent Application No. 201420874292.7, dated Mar. 6, 2015, 1 page.

International Preliminary Report on Patentability, International Patent Application No. PCT/US2014/065968, May 26, 2016, 12 pages.

International Preliminary Report on Patentability, International Patent Application No. PCT/US2014/065996May 26, 2016, 14 pages.

* cited by examiner

CONNECTOR INSERT ASSEMBLY

CROSS-REFERENCES TO RELATED APPLICATIONS

This application is a continuation-in-part of U.S. patent application Ser. No. 14/543,803, filed Nov. 17, 2014, which claims the benefit of U.S. provisional patent application No. 62/003,012, filed May 26, 2014, which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power may be transferred with this data, or power may be transferred separately.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to form pathways for power and data.

The data rates through these connector inserts may be quite high. To provide these high data rates, it may be desirable that these connector inserts have good matching, a high signal integrity, and low insertion loss. This may require the impedance of signal contacts in the connector insert to be matched and close to a target value.

These connector inserts may be inserted into a device receptacle once or more each day for multiple years. It may be desirable that these connector inserts have and maintain a pleasant physical appearance as a poor appearance may lead to user dissatisfaction with both the cable assembly and the electronic devices that it connects to.

Electronic devices may be sold in the millions, with an attendant number of cable assemblies and their connector inserts sold alongside. With such volumes, any difficulties in the manufacturing process may become significant. For such reasons, it may be desirable that these connector inserts may be reliably manufactured.

Thus, what is needed are connector inserts having signal contacts with a matched impedance near a target value for good signal integrity and low insertion loss, a pleasant physical appearance, and that may be reliably manufactured.

SUMMARY

Accordingly, embodiments of the present invention may provide connector inserts having contacts with a matched impedance near a target value for good signal integrity and low insertion loss, a pleasant physical appearance, and that may be reliably manufactured.

An illustrative embodiment of the present invention may provide connector inserts having signal contacts with a matched impedance near a target value to improve signal integrity and provide a low insertion loss in order to allow high data rates. This matching may be achieved in part by increasing an impedance of the signal contacts. For example, various embodiments of the present invention may include ground planes between rows of contacts in a connector in order to electrically isolate signals in the different rows from each other. Also, a grounded shield may surround these rows of contacts. The ground plane and shield may increase capacitance to the signal contacts, thereby lowering the impedance at the contacts below a target value and thereby degrading signal integrity. Accordingly, in order to improve signal integrity and facilitate matching, embodiments of the present invention may thin or reduce thicknesses of one or more of the shield, ground plane, or contacts in order to increase the distances between the structures. This increase in distance may increase the impedance at the contacts to near a target value, again improving matching among the signal contacts.

In other embodiments of the present invention, the shape of a signal contact when it is in a deflected or inserted state may be optimized. For example, a contact may be contoured to be at a maximum distance from the ground plane and shield over its length in order to increase impedance at the contact. In a specific embodiment of the present invention where the ground plane and shield are substantially flat, the signal contacts may be substantially flat as well, and where either or both the ground plane and shield are curved, the signal contacts may be substantially curved as well.

In this embodiment of the present invention, the signal contacts of a connector insert may be designed to be substantially flat when the connector insert is inserted into a connector receptacle. This design may also include a desired normal force to be applied to a contact on a connector receptacle by a connector insert signal contact. From this design, the shape of the connector insert signal contacts when the connector insert is not inserted in a connector receptacle may be determined. That is, from knowing the shape of a connector insert signal contact in a deflected state and the desired normal force to be made during a connection, the shape of a connector insert signal contact in a non-deflected state may be determined. The connector insert signal contacts may be manufactured using the determined non-deflected state information. This stands in contrast to typical design procedures that design a contact beginning with the non-deflected state.

These and other embodiments of the present invention may provide connector inserts having a pleasant appearance. In these embodiments, a leading edge of the connector insert may be a plastic tip. This plastic tip may be a front portion of a housing in the connector insert. Embodiments of the present invention may provide features to prevent light gaps from occurring between the plastic tip and shield. One illustrative embodiment of the present invention may provide a step or ledge on the plastic tip to block light from passing between the plastic tip and the shield. In other embodiments of the present invention, a force may be exerted on the shield acting to keep the shield adjacent to, or in proximity of, the plastic tip. This force may be applied at a rear of the shield by one or more arms having ramped surfaces, where the arms are biased in an outward direction and the ramps are arranged to apply a force to the shield.

After a connector insert portion has been manufactured, a cable may be attached to it. The cable may include a ground shield or braiding. During cable attachment, the braiding may be pulled back and a ground cap may be placed over the braiding. The cap may then be crimped to secure the cable in place. The crimping may be done with a multi-section die, where contacting surfaces of the die include various points or peaks along their surface. These points may effectively wrinkle or jog the perimeter of the cap, thereby reducing the dimensions of a cross-section of the cable. This reduction in cross section may improve the flow of plastic while a strain relief is formed around the cable. This may, in turn, increase the manufacturability of the connector insert.

Another illustrative embodiment of the present invention may include retention springs for a connector insert. These retention springs may engage notches on sides of the tongue of a connector receptacle when the connector insert is inserted into the connector receptacle. These retention springs may include a contacting portion for engaging the notches on the tongue. The retention springs may also include an optional dimple. The dimple, if present, may engage in inside of a shield of the connector insert while the connector insert is inserted into the connector receptacle, otherwise, the retention spring surface itself may engage the inside of the shield while the connector insert is being inserted. In other embodiments of the present invention, the dimple if present, may engage in inside of the shield before the connector insert is inserted, otherwise the retention spring surface itself may engage the inside of the shield before the connector insert is inserted. The retention spring may include a deflection arm extending from the dimple, if present, to the contacting portion. In other embodiments of the present invention, the deflection arm may extend from a location where the retention spring contacts the shield to the contacting portion. A majority of the length of the retention spring may be made up of this deflection arm. This deflection arm may deflect as the connector insert is inserted into a connector receptacle. In this way, stresses may be spread out over the retention spring during insertion. This may help to avoid a concentration of stress that could otherwise cause a cold working failure or cracking in the retention spring. Specifically, a surface or dimple (if present) may contact a surface, such as a shield, when the connector insert starts to be inserted into a connector receptacle. Force or stress may concentrate here, but the retention spring may be made thicker or wider in one or more directions here to support the stress. As the insert continues to be inserted, the deflection arm may deflect, absorbing stresses over a long portion of the retention spring. Particularly where no dimple is present, the contact area between the retention spring and shield or other surface may "rock" or move along the length of the retention spring (towards the contacting portion), again helping to distribute the points of high stress compensation. This configuration may provide a retention spring that is hard enough to provide a good retention force but not fail due to cold working. These retention springs may be formed in various ways. For example, the may be forged, stamped, metal-injection-molded, or formed in other ways.

Another illustrative embodiment of the present invention may include ground contacts near a front opening of the connector insert. These ground contacts may be connected by a cross piece. The cross piece may be supported by one or more spring structures, which may wrap laterally around a front portion of a housing for the connector insert. In a specific embodiment of the present invention, the support structures may wrap around approximately one-half of a circumference of the housing.

Another illustrative embodiment of the present invention may provide a connector insert having a front lip. An inside portion of the front lip may be formed of a nonconductive housing, while an outside portion may be formed of a conductive shield. This arrangement may help to prevent the conductive shield from contacting and shorting contacts on a tongue of a connector receptacle while the connector insert is inserted into the connector receptacle. To further protect against shorting receptacle contacts, the housing may be arranged to be either aligned with or extending beyond the shield. Also, having a portion of lip formed by the shield may help to strengthen a leading edge of the connector insert.

The signal contacts included in a connector insert according to an embodiment of the present invention may be pre-biased to provide a force against contacts on a top of a connector receptacle. This pre-bias may provide a force at a front opening of the connector insert in a direction such that the opening may tend to close up. Accordingly, embodiments of the present invention may provide an end cap having bowed outside edges. These outwardly bowed edges may provide a countervailing force during manufacturing to help the opening of the connector insert to remain open.

In various embodiments of the present invention, contacts, shields, and other conductive portions of connector inserts and receptacles may be formed by stamping, metal-injection molding, machining, micro-machining, 3-D printing, forging, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
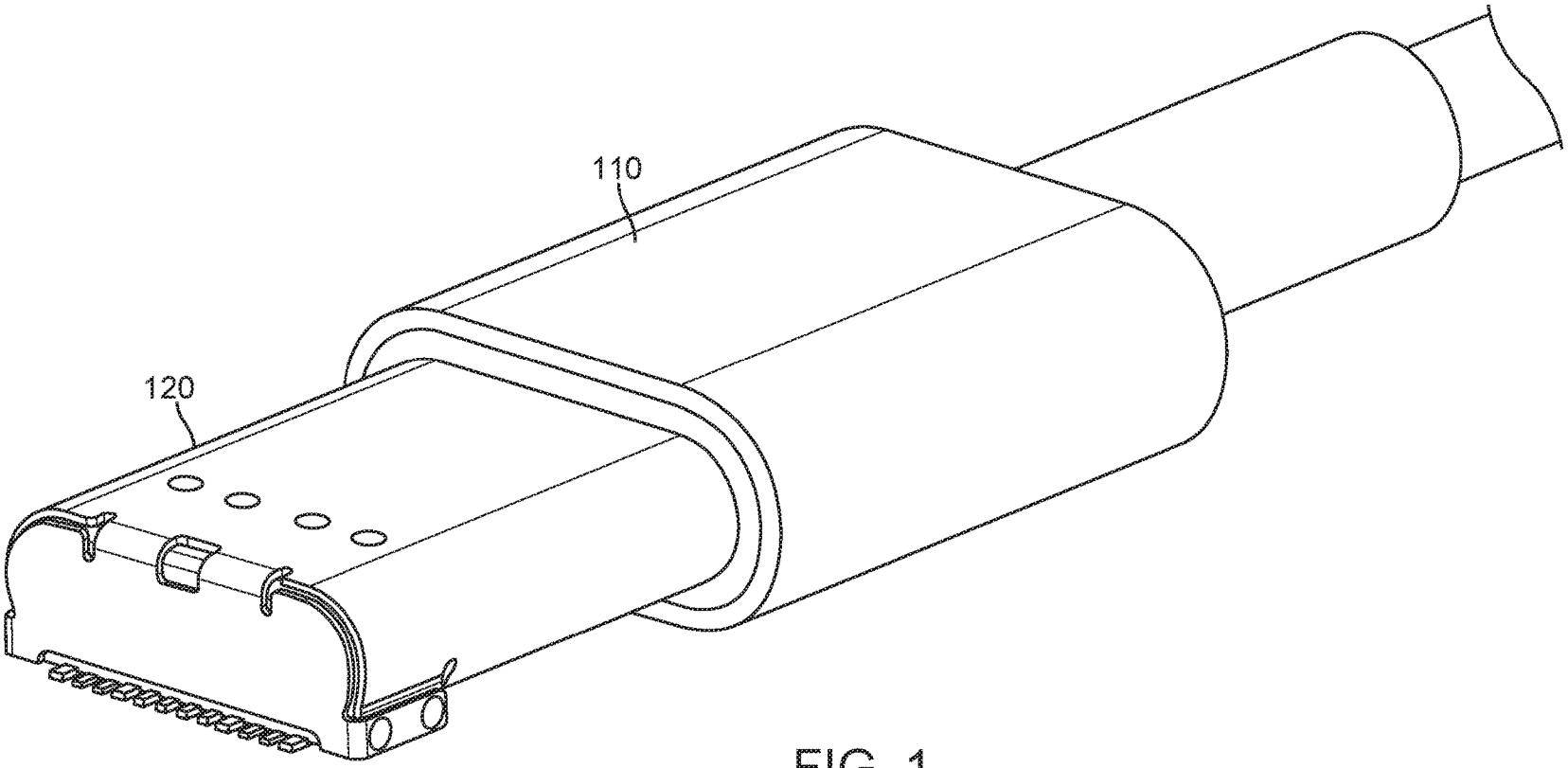
FIG. 1 illustrates a connector insert according to an embodiment of the present invention that has been inserted into a connector receptacle according to an embodiment of the present invention.

FIG. 1 illustrates a connector insert according to embodiments of the present invention that is been inserted into a connector receptacle according to an embodiment of the present invention. This figure, as with the other included figures, is shown for illustrative purposes and does not limit either the possible embodiments of the present invention or the claims.

Specifically, connector insert 110 has been inserted into connector receptacle 120. Receptacle 120 may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. Connector insert 110 and receptacle 120 may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In other embodiments of the present invention, connector insert 110 and receptacle 120 may be used to provide a reduced set of functions for one or more of these standards. In various embodiments of the present invention, these interconnect paths provided by connector insert 110 and receptacle 120 may be used to convey power, ground, signals, test points, and other voltage, current, data, or other information. More information about connector insert 110 and receptacle 120 may be found in co-pending United States patent application number 14/543,711, filed Nov. 17,2014, titled CONNECTOR RECEPTACLE HAVING A SHIELD, which is incorporated by reference.

Connector insert 110 may include a number of contacts for conveying signals. These signals may include high-speed differential signals, as well as other types of signals. To increase signal integrity and reduce insertion losses, it may be desirable to increase an impedance of the signal contacts. More specifically, it may be desirable to match the impedance across the various contacts in a connector plug or insert so that they all have a value near a target value. In some embodiments of the present invention, this matching is facilitated by decreasing capacitances between the signal contacts in the connector insert to other conductive structures in the connector insert 110 and connector receptacle 120. This may be done by increasing the physical spacing between the signal contacts and these other structures.

Various connector receptacles may include ground structures, such as shields or center ground planes, or both. These shields and ground planes may have a particularly contour, which may be but is not necessarily flat. The signal contacts may then be designed to have a similar contour when they are deflected due to the connector insert being inserted into a connector receptacle. From this deflected shape, a non-deflected shape may be determined. From this non-deflected shape the contact may be formed. Variations between the shape of the contact and the shape of the ground structures may exist. These variations may be adjusted based at least in part on a desired contact force between the contact for the connector insert and a corresponding contact in a connector receptacle. This contact force may also at least partially account for differences between the deflected and non-deflected shapes of the contact for the connector insert. An example of this is shown in the following figures.

Figure 2:
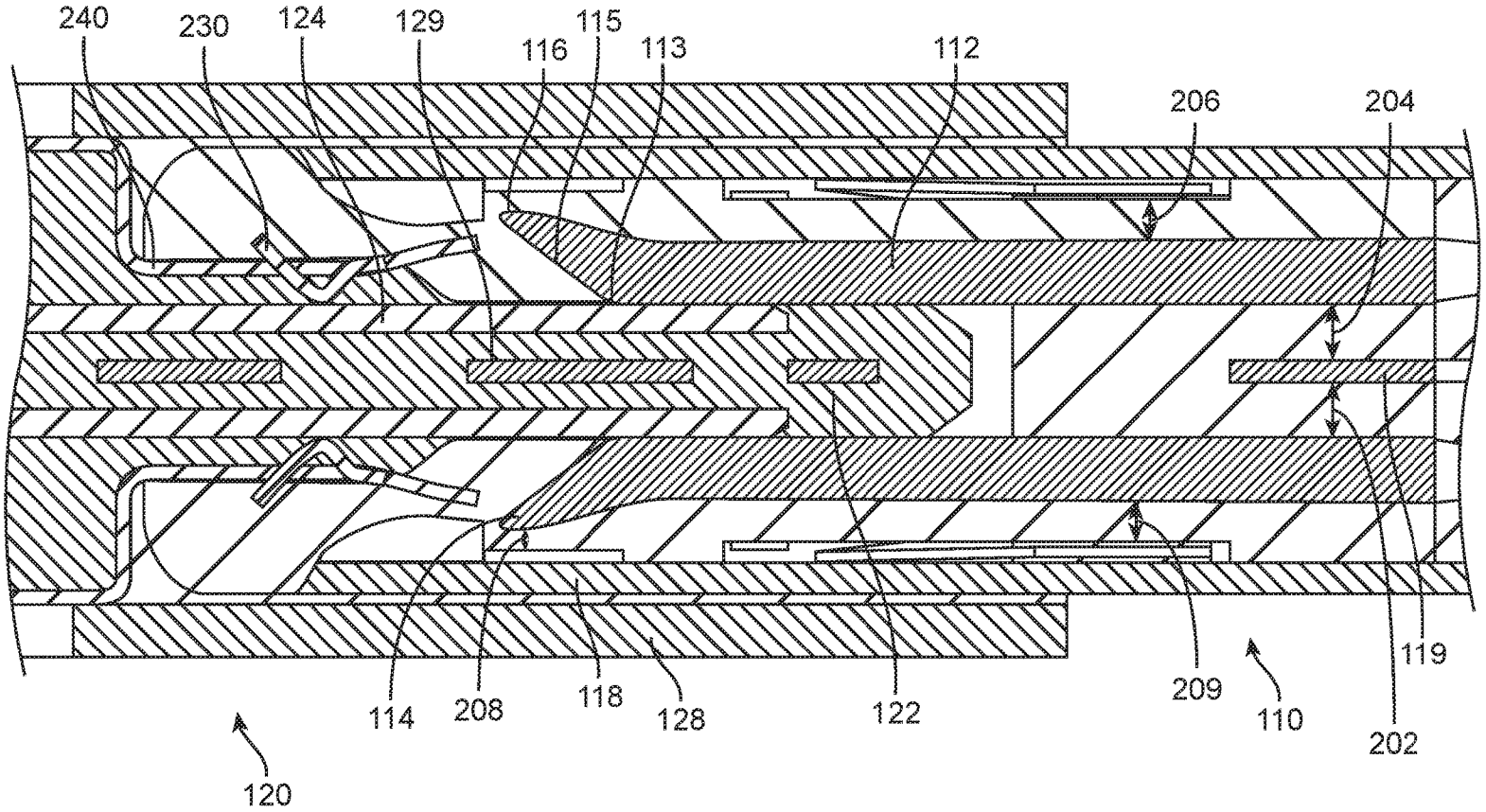
FIG. 2 illustrates a portion of a connector system according to an embodiment of the present invention.

FIG. 2 illustrates a portion of a connector system according to an embodiment of the present invention. This figure includes a connector insert 110 having signal contacts 112 and 114, shield 118, and center ground plane 119. This figure also includes a connector receptacle 120 including a tongue 122 having a center ground plane 129, shield 128, and contacts 124. Contacts 124 may engage contacts 112 and 114 at locations 113 when connector insert 110 is inserted into connector receptacle 120. Ground contacts, such as ground contacts 230, may electrically connect to contacts 240 on receptacle tongue 122. Ground contacts 240 may connect to shield 128 in the receptacle, which may electrically connect to shield 118 on the insert. Shield 118 may connect to ground contact 230, thereby forming a ground shield around tongue 122 and contacts 114.

Since contacts 112 and 114 are between shield 118 (and shield 128) and central ground planes 119 and 129, contacts 112 and 114 may capacitively couple to shield 118 and center ground planes 119 and 129. This capacitance may increase with decreasing distance. This increase in capacitance may reduce the impedance at signal contacts 112 and 114, thereby reducing signal integrity. This reduction in capacitance may complicate the overall goal of matching the impedance near a target value at signal contacts 112 and 114.

Accordingly, embodiments of the present invention may reduce a thickness of one or more of signal contacts 112 and 114, shield 118, shield 128, and center ground planes 119 and 129. These decreasing thicknesses may increase a distance or spacing between these structures, thereby increasing impedance. In other embodiments of the present invention, signal contacts 112 and 114 may be contoured to increase distances, such as distances 202 and 204 to center ground planes 119 and 129, and distances 208 and 209 to shields 118 and their associated ground contacts. For example, where shield 128 and center ground plane 119 may be curved, contacts 112 and 114 may be curved as well in order to maximize these distances. In a special case as illustrated, center ground plane 119, center ground plane 129 in the connector receptacle tongue 122, and shields 118 and 128 have substantially straight or flat surfaces. Accordingly, signal contact 112 and 114 may be arranged to be substantially flat in a deflected state when in the connector insert is inserted into the connector receptacle.

Signal contacts 112 and 114 may be designed using a method according to an embodiment of the present invention, where the design process begins with signal contacts 112 and 114 in this nearly flat or straight deflected state. That is, signal contacts may be designed to follow the contours of the central ground planes 119 and 129 and shields 118 and 128 in the state where connector insert 110 is inserted into connector receptacle 120. A desired normal force at location 113 may be factored in as well. From this, a shape of signal contacts 112 and 114 in a non-deflected or extracted state may be determined. Signal contacts 112 and 114 may be manufactured in this state and used an embodiment of the present invention. This stands in contrast to conventional design techniques that begin by designing a signal contact in a non-deflected or non-inserted state.

Unfortunately, it may be problematic to form signal contacts 112 and 114 such that they are completely flat in a deflected state. For example, at least a slight amount of curvature at location 113 may be desirable such that contact is made between signal contact 112 in the connector insert and signal contact 124 in the connector receptacle. Specifically, without such curvature, a portion of connector insert signal contact 112 may rest on a front of the tongue 122. This may cause contact 112 to lift at location 113 and disconnect from connector receptacle contact 124. Also, to avoid tongue 122 from engaging an edge of signal contact 112 during insertion, a raised portion 115 having a sloped leading edge and a tip 116 may be included at an end of signal contact 112. This raised portion 115 may cause a localized drop or dip in the impedance of signal contact 112. To reduce this dip or reduction in impedance, raised portions 115 may have a substantially flat surface at tip 116 in an attempt to increase the distance between tip 116 and shield 118. That is, tip 116 may have a top surface that is substantially parallel to shield 118.

Figure 3:
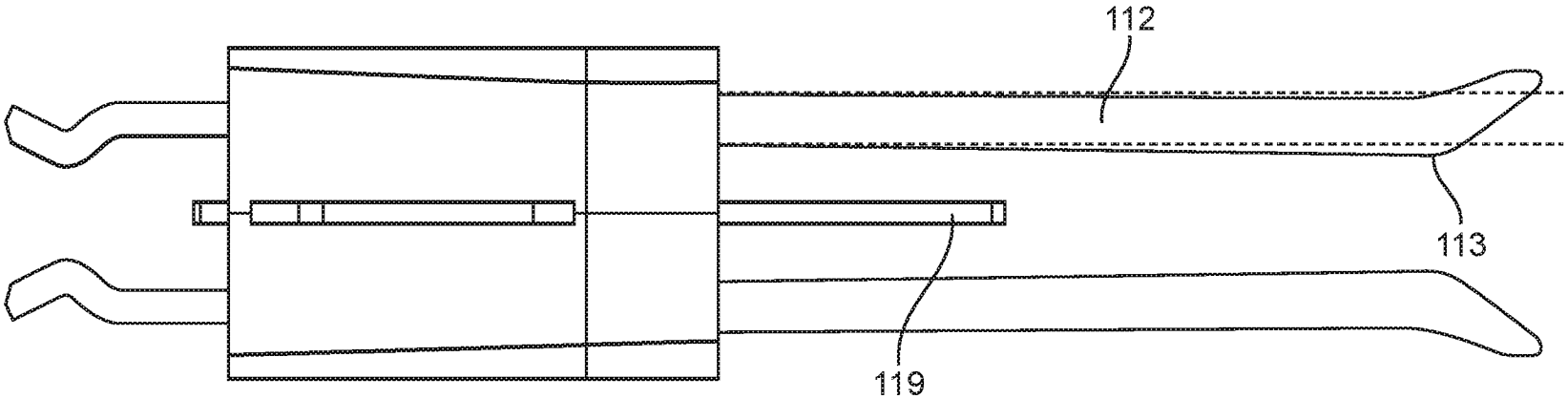
FIG. 3 illustrates signal contacts in a deflected or inserted state according to an embodiment of the present invention.

FIG. 3 illustrates signal contacts in a deflected or inserted state according to an embodiment of the present invention. As shown, contacts 112 may be substantially flat. Deviations from this at location 113 may be present, as described above. From this arrangement, as well as the desired force to be applied at location 113, the shape of signal contacts 112 in a non-deflected state may be determined. An example is shown in the following figure.

Figure 4:
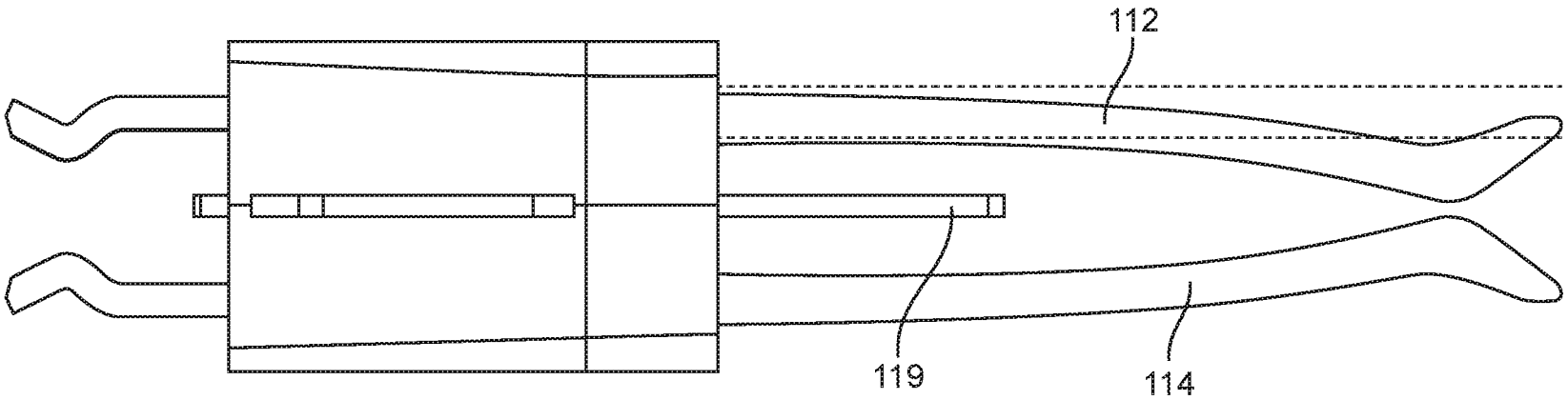
FIG. 4 illustrates signal contact in a non-deflected or extracted state according to an embodiment of the present invention.

FIG. 4 illustrates signal contact in a non-deflected or extracted state according to an embodiment of the present invention. As shown, contacts 112 and 114 may bend towards each other in the non-inserted state. Signal contacts 112 and 114 may be manufactured in the non-deflected state and used an embodiment of the present invention. Again, when the connector insert including contact 112 is inserted in a corresponding connector receptacle, contact 112 may defect to a substantially flat or straight position.

Various embodiments of the present invention may include a tip, formed of plastic or other material, on a front leading edge of a connector insert. In these embodiments of the present invention, it may be desirable to ensure that there are no gaps or spaces visible between the plastic tip and shield of a connector insert. Accordingly, embodiments of the present invention may provide features to reduce or limit these gaps. Examples are shown in the following figures.

Figure 5:
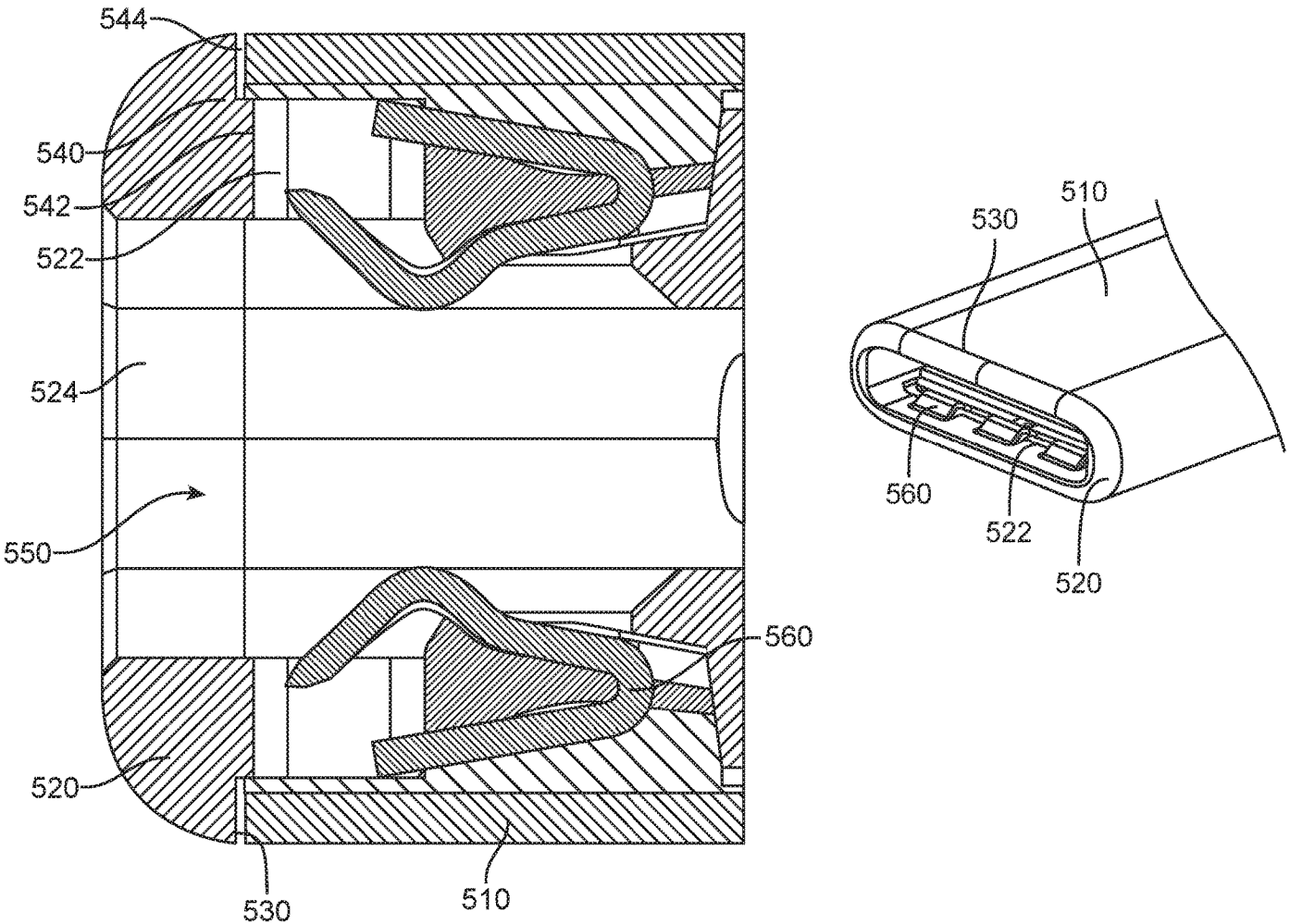
FIG. 5 illustrates a front end of a connector insert according to an embodiment of the present invention.

FIG. 5 illustrates a front end of a connector insert according to an embodiment of the present invention. In this example, plastic tip 520 may be located on a front of the connector insert next to shield 510. That is, shield 510 may meet the plastic tip 520 at a rear of the plastic tip 520 away from a front of the connector insert. While plastic tip 520 may be made of plastic, it may instead be formed of other non-conductive material. A plastic tip 520 may be used to avoid marring of the connector insert and corresponding connector receptacle and to preserve their appearance over time. Plastic tip 520 may also be durable as compared to metallic or other types of front ends. Plastic tip 520 may be a front end of a molded portion or housing 524 in the connector insert.

A gap 530 between plastic tip 520 and shield 510 may exist. This arrangement may allow light from opening 550 to pass through opening 522, which may be present for ground contacts 560 to electrically connect to shield 510, through gap 530 where it may be visible to a user. Accordingly, plastic tip 520 may include a ledge portion 540 to block light that may otherwise pass through gap 530. Specifically, ledge 540 may be present between edges 544 and 542. Ledge 540 may effectively cover an end of gap 530, thereby preventing light leakage. Put another way, opening 522 may be formed such that it has a leading edge 542 that is behind gap 530 in the direction away from the front opening of the connector insert.

In other embodiments of the present invention, a force may be applied to the remote end of shield 510 to reduce the gap 530 between shield 510 and plastic tip 520. An example is shown in the following figure.

Figure 6:
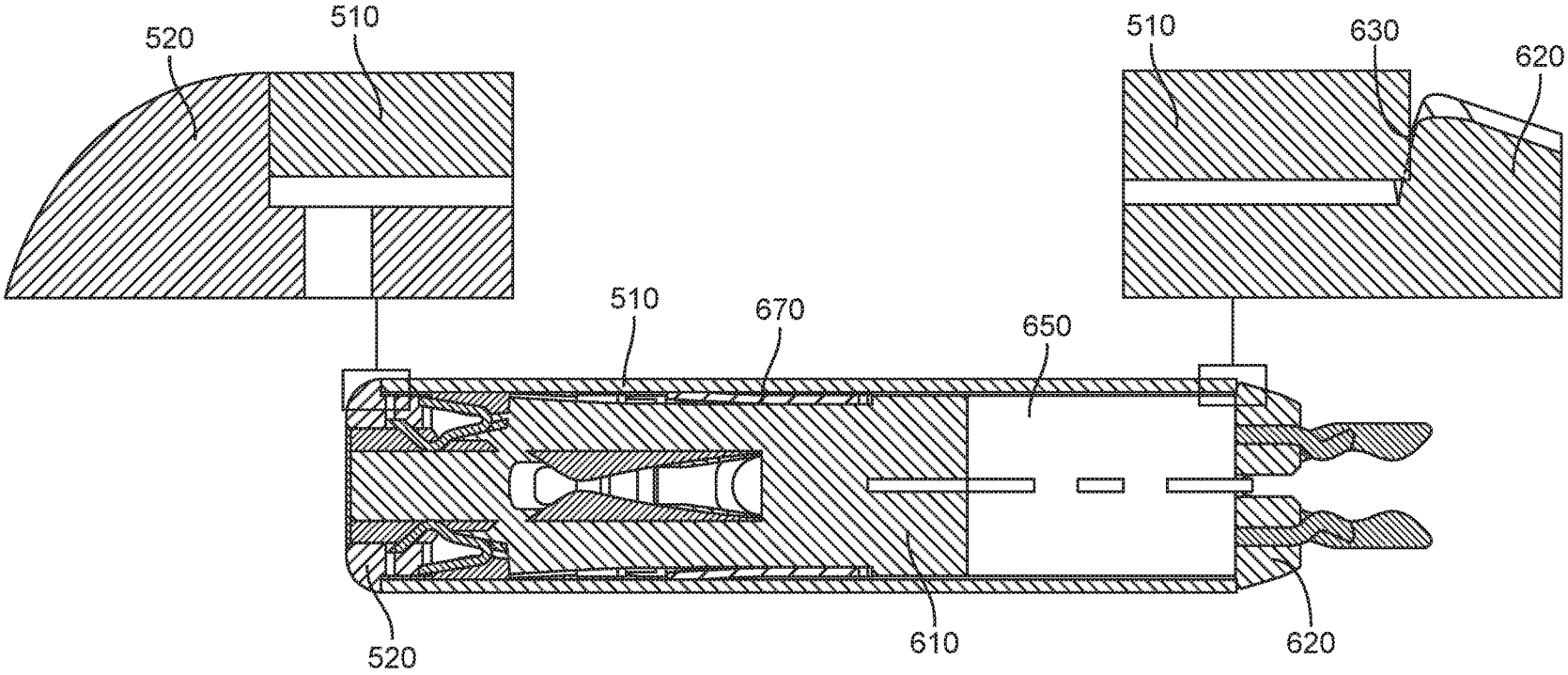
FIG. 6 illustrates a portion of a connector insert according to an embodiment of the present invention.

FIG. 6 illustrates a portion of a connector insert according to an embodiment of the present invention. In this example, shield 510 may be adjacent to or in close proximity to plastic tip 520. This close proximity may be caused by a force being applied to shield 510. Specifically, during assembly, arms 620 may be compressed or folded in closer to each other such that shield 510 may be slid over plastic portion 610. When shield 610 reaches plastic tip 520, arms 620 may be released, whereupon they may push out and against an end of shield 510. That is, arms 620 may be biased outward such that when they are released, they push out and against a rear portion of shield 510. Specifically, a surface 630 of arms 620 may be ramped or sloped such that a force is applied to shield 510 moving it adjacent to or in close proximity to plastic tip 520. A molded piece 650 may be inserted through a back end of shield 510 in order to force arms 620 outward, thereby holding shield 510 in place against plastic tip 520.

In this example, tape piece 670 may be included. Tape piece 670 may help to prevent signal contacts in the connector insert from contacting shield 510. Tape piece 670 may be sloped as shown so that it is not caught on the leading edge of shield 510 as shield 510 slides over plastic housing 610 during assembly.

Once this connector insertion portion is complete, a housing and cable may be attached to a rear portion of the assembly. This may be done in a way that avoids or reduces various problems in the manufacturing process An example is shown in the following figure.

Figure 7:
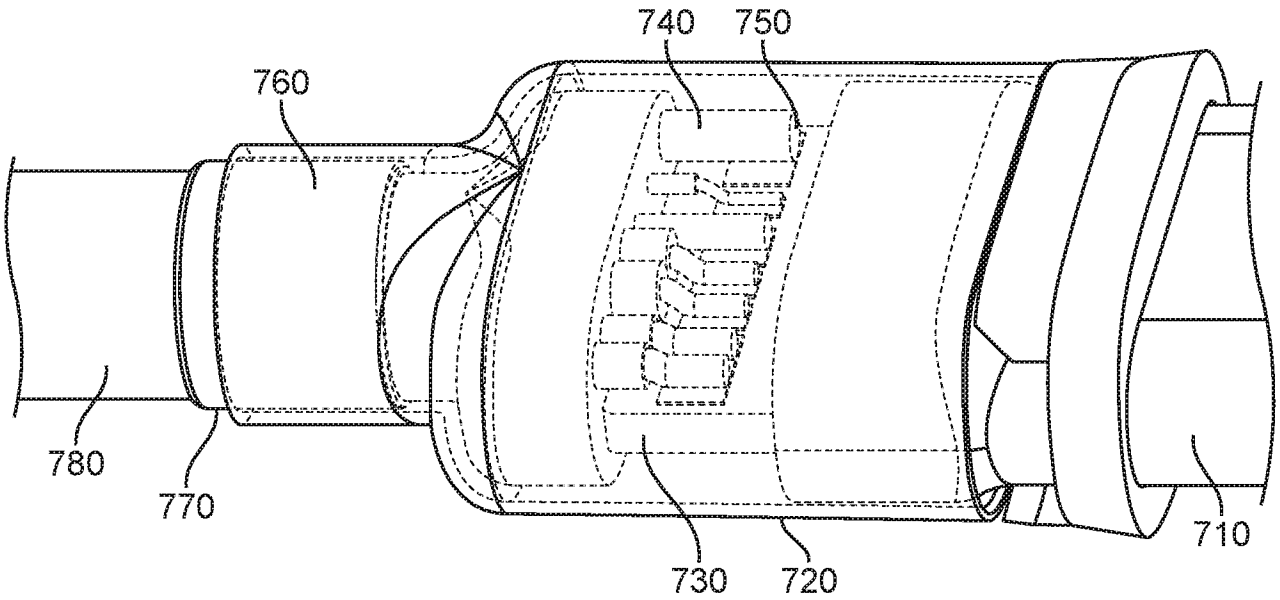
FIG. 7 illustrates a portion of a connector insert according to an embodiment of the present invention.

FIG. 7 illustrates a portion of a connector insert according to an embodiment of the present invention. In this example, cable 780 may pass through cap 770. Cap 770 may be covered or partially covered by strain relief 760. Conductors 740 in cable 780 may terminate on printed circuit board 730 at contacts 750. Traces (not shown) on printed circuit board 730 may connect contacts 750 to contacts in the connector insert. The printed circuit board 730 of a connector insert may be housed in housing 720.

Figure 8:
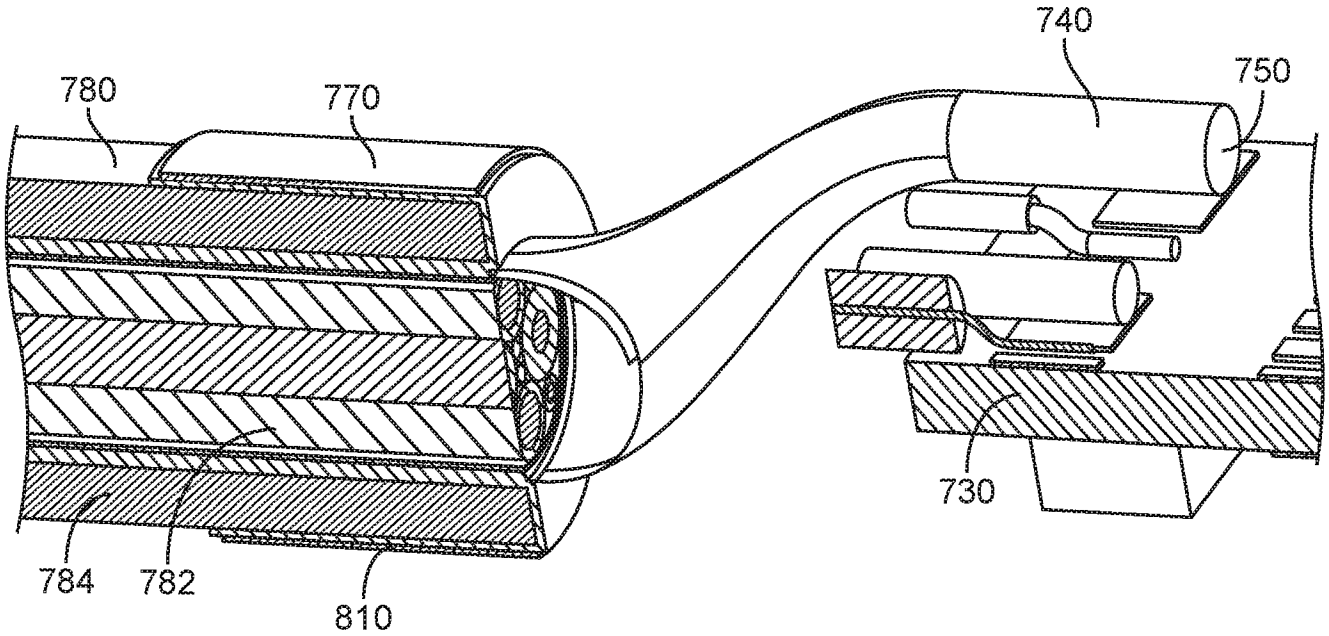
FIG. 8 illustrates a cutaway view of a portion of a connector insert according to an embodiment of the present invention.

FIG. 8 illustrates a cutaway view of a portion of a connector insert according to an embodiment of the present invention. Again, conductors 740 may terminate at pads 750 on printed circuit board 730. Braiding 810 of cable 780 may be folded back onto itself and crimped by cap 770. An example of how this crimping maybe done is shown in the following figure.

Figure 9:
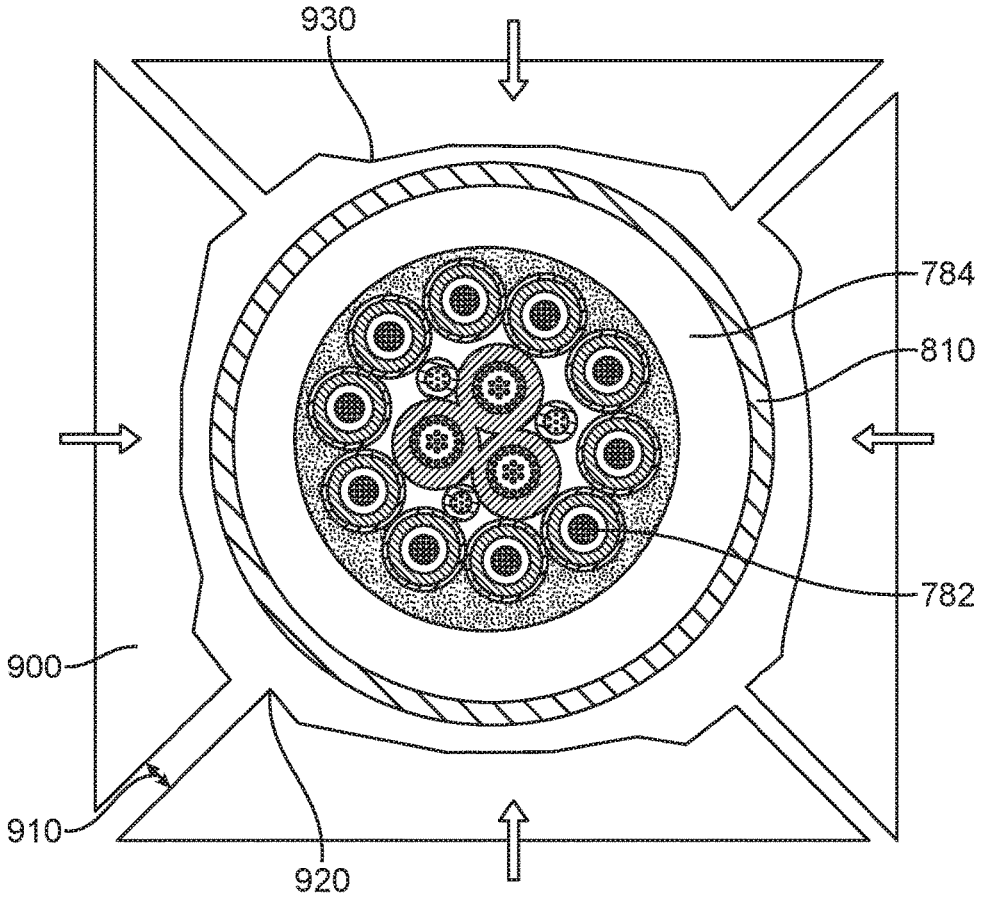
FIG. 9 illustrates a structure for crimping a cap around an end of a cable according to an embodiment of the present invention.

FIG. 9 illustrates a structure for crimping a cap around an end of a cable according to an embodiment of the present invention. In this example, four tool die pieces 900 may be used. These die pieces may be pushed inwards until gap 910 is reduced to a small or zero distance between each tool die 900. This may crimp cap 770 around the braiding 6410 of cable 780. The tool die piece 900 may include various points or peaks, such as 920 and 930. These points may effectively wrinkle or jog the perimeter of the cap, thereby reducing the dimensions of a cross-section of cable 780. This may improve the flow of plastic while forming strain relief 760 around cable 780.

Embodiments of the present invention may provide connector inserts having improved ground contacts and retention spring features. An example is shown in the following figure.

Figure 10:
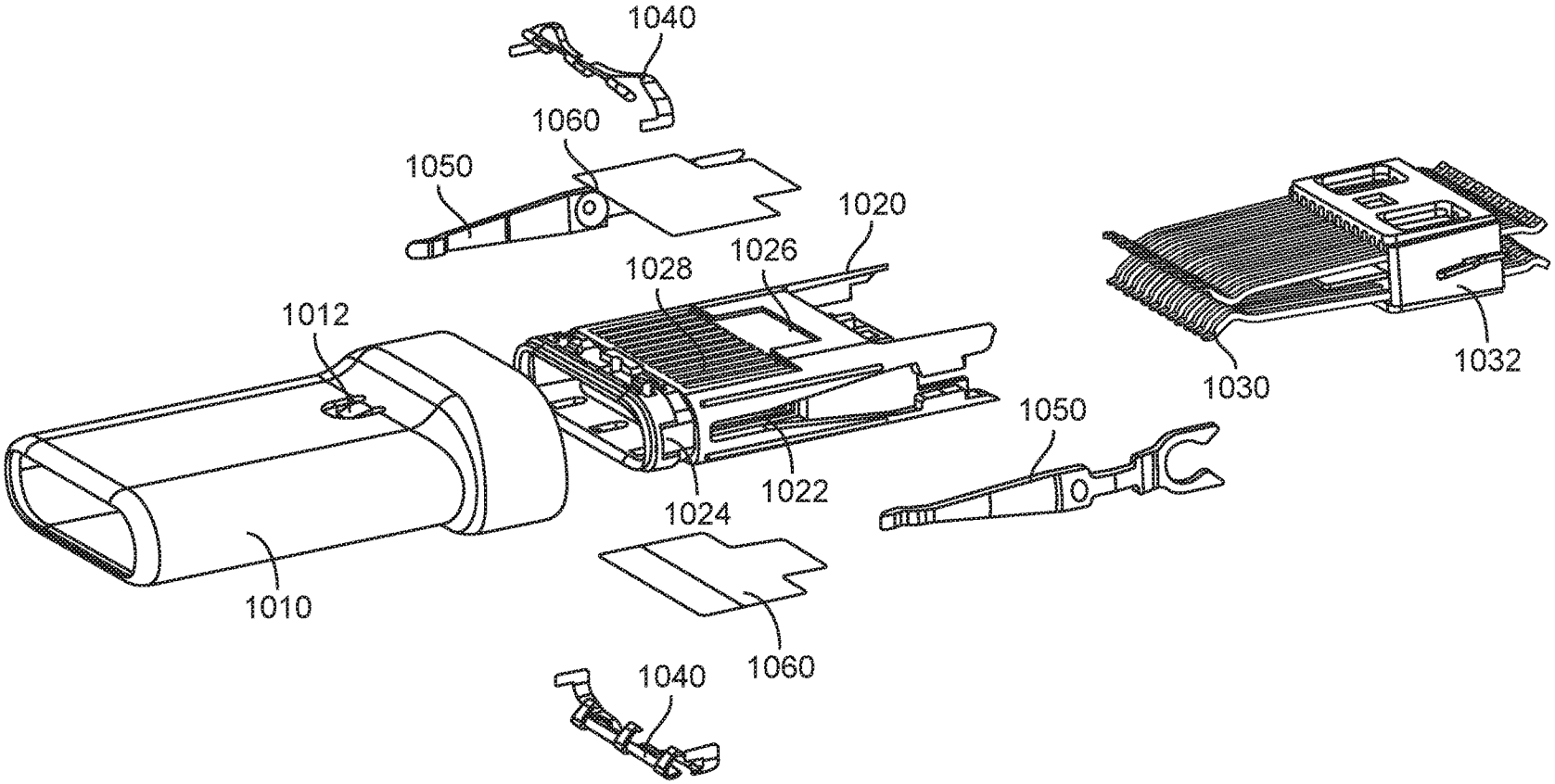
FIG. 10 illustrates an exploded view of a connector insert according to an embodiment of the present invention.

FIG. 10 illustrates an exploded view of a connector insert according to an embodiment of the present invention. This connector insert may include a shield 1010 around housing 1020. A number of contacts 1030 may be placed in housing 1020. Specifically, contacts 1030 may be located in slots 1028 and top and bottom sides of housing 1020. Secondary housing 1032 may secure contacts 1030 together as a unit. Side retention springs 1050 may be located in side openings 1022 in housing 1020. Ground contacts 1040 may be located at a front of the connector insert between an opening of a connector insert and contacts 1030. Ground contacts 1040 may be located in groves 1024 in housing 1020. Insulating layers 1060 may be used to prevent contacts 1030 from contacting shield 1010. Insulating layers 1060 may be pieces of Kapton tape or other insulating material. Shield 1010 may include tabs 1012 which may engage notch 1026 when housing 1020 is inserted into shield 1010 during manufacturing.

Figure 11:
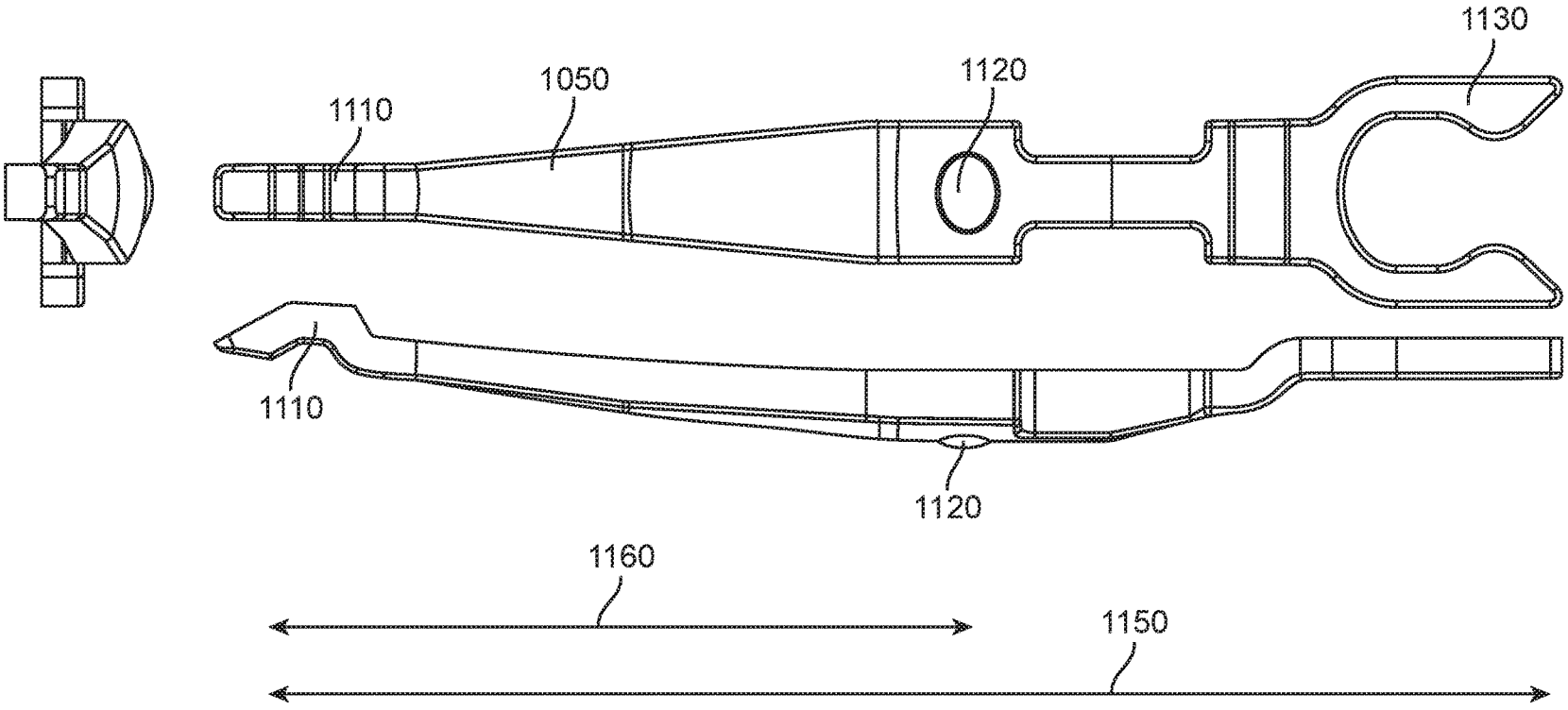
FIG. 11 illustrates a retention spring that may be used in a connector insert according to an embodiment of the present invention.

FIG. 11 illustrates a retention spring that may be used in a connector insert according to an embodiment of the present invention. Retention springs 1050 may include a contacting portion 1110. Contacting portion 1110 may engage a notch in a tongue in a connector receptacle when a connector insert is inserted into the connector receptacle. Retention spring 1050 may further include dimple 1120, though in other embodiments of the present invention, dimple 1120 may be absent. Dimple 1120, if present, or the surface of retention spring 1050 if not, may engage in inside of shield 1010 when the connector insert is inserted into a connector receptacle. In other embodiments of the present invention, dimple 1120, if present, or the surface of retention spring 1050 if not, may contact and inside of shield 1010 before the connector insert is inserted into a connector receptacle. Retention spring 1050 may further include prongs 1130. Prongs 1130 may secure retention spring 1050 to a housing of the connector insert.

Retention spring 1050 may have an overall first length 1150. Retention spring 1050 may also include a deflection arm 1160. The deflection arm 1160 may extend from dimple 1120, if present, to contacting portion 1110. In other embodiments of the present invention, the deflection arm 1160 may extend from a location where the retention spring 1050 contacts the shield 1010 to the contacting portion 1110. The deflection arm portion 1160 may consume a majority of the length of retention spring 1050. That is, the length of the deflection arm 1160 may be more than one half of the length 1150 of the total retention spring. In this way, stresses may be spread out over the retention spring 1050 during insertion. This may help to avoid a concentration of stress that could otherwise cause a cold working failure or cracking in the retention spring 1050. Specifically, a surface or dimple 1120 (if present) of retention spring 1050 may contact a surface, such as an inside of shield 1010, when the connector insert starts to be inserted into a connector receptacle. Force or stress may concentrate at this point, but the retention spring may be made thicker or wider in or more directions near dimple 1120 (if present) to support the stress. As the insert continues to be inserted, the deflection arm may deflect, absorbing further stresses over a long portion of the retention spring 1050. Particularly where no dimple 1120 is present, the contact area between retention spring 1050 and shield 1010 or other surface may "rock" or move along the length of the retention spring 1050 (towards the contacting portion 1110), again helping to distribute the points of high stress compensation. This configuration may provide a retention spring that is hard enough to provide a good retention force but not fail due to cold working. These retention springs may be formed in various ways. For example, the may be forged, stamped, metal-injection-molded, or formed in other ways. Further details on these retention springs may be found in co-pending U.S. patent application Ser. No. 14/543,748, filed Nov. 17, 2014, which is incorporated by reference.

Figure 12:
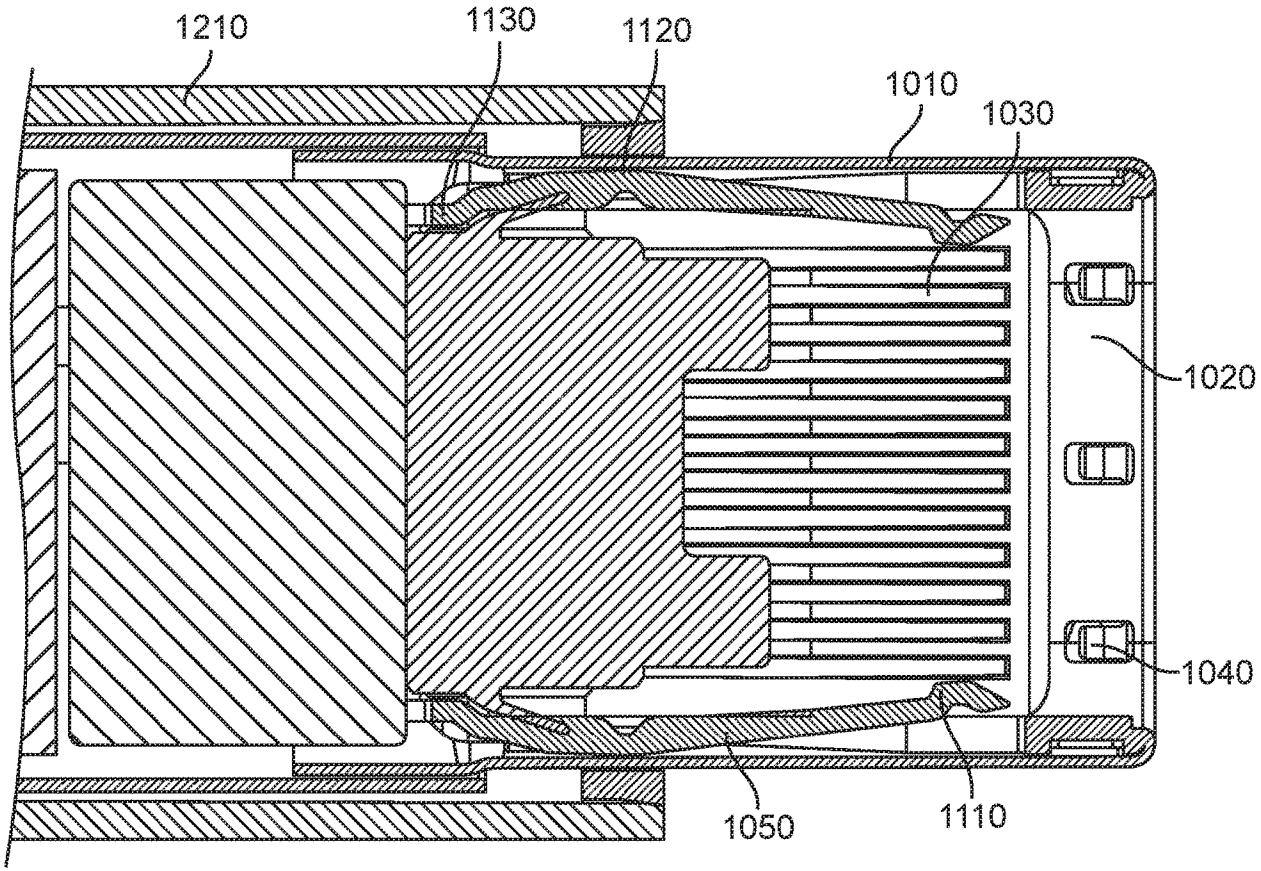
FIG. 12 illustrates a top cut-away view of a connector insert according to an embodiment of the present invention.

FIG. 12 illustrates a top cut-away view of a connector insert according to an embodiment of the present invention. This connector insert may include a number of contacts 1030. Ground contacts 1040 may be located between contacts 1030 and a front opening and housing 1020. Retention springs 1050 may be located along outside edges of the connector insert. Retention springs 1050 may include contacting portions 1110. Contacting portion 1110 may engage and fit in a notch on sides of a tongue of a connector receptacle when the connector insert is inserted into the connector receptacle. Retention springs 1050 may further include dimple 1120, though dimple 1120 may be absent in various embodiments of the present invention. Dimple 1120, if present, may engage an inside of shield 1010 when the connector insert is inserted into a connector receptacle, or before and while the connector insert is inserted into a connector receptacle. If dimple 1120 is not present, the retention spring surface itself may engage an inside of shield 1010 when the connector insert is inserted into a connector receptacle, or before and while the connector insert is inserted into a connector receptacle. Retention springs 1050 may include prongs 1130 for securing retention springs 1050 to the insert housing. An outside housing 1210 may surround a rear portion of the connector insert. Housing 1210 may be grasped by a user during the insertion and extraction of the connector insert into and out of a connector receptacle.

Figure 13:
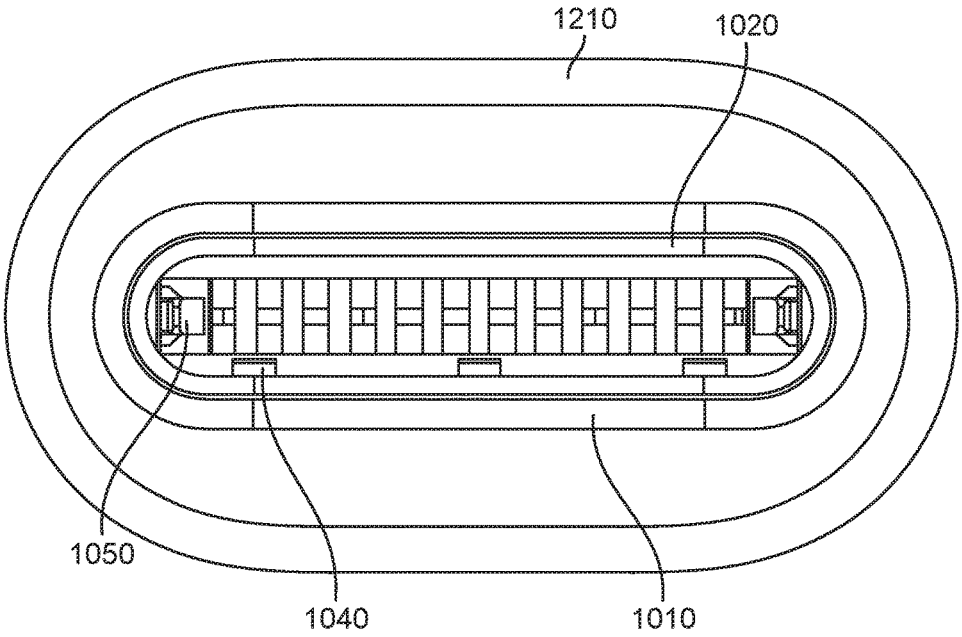
FIG. 13 illustrates a front view of a connector insert according to an embodiment of the present invention.

FIG. 13 illustrates a front view of a connector insert according to an embodiment of the present invention. Again, the connector insert may have a shield 1010 around housing 1020. Retention springs 1050 may be located in openings and sides of housing 1020. Ground contacts 1040 may be located near a front opening of the connector insert. A housing 1210 may surround a rear portion of a connector insert.

The connector insert may include a front lip defining a front opening. This lip may have an inside portion formed of housing 1020 and an outside portion formed of shield 1010. By providing an inside portion of the lip formed of a non-conductive material, shield 1010 is less likely to engage and short to contacts on a tongue of a connector receptacle while the connector insert is being inserted into the connector receptacle. To further protect against shorting receptacle contacts, the housing 1020 may be arranged to be either aligned with or extending beyond the shield 1010. Having at least a portion of the lip formed of shield 1010 may help to improve the strength of the leading edge of the connector.

As shown in FIG. 2 above, the connector insert may include front ground contacts for engaging ground contacts on a connector receptacle tongue when the connector insert is inserted into the connector receptacle. It may be desirable that these ground contacts do not increase an overall length of an insert portion of a connector insert dramatically. An example of such a ground contact is shown in the following figure. The operation of such a ground contact was shown above in reference to ground contact 230 in FIG. 2. Other examples and further information regarding the operation of these ground contacts may be found in co-pending U.S. patent application Ser. No. 14/543,717, filed Nov. 17, 2014, which is incorporated by reference.

Figure 14:
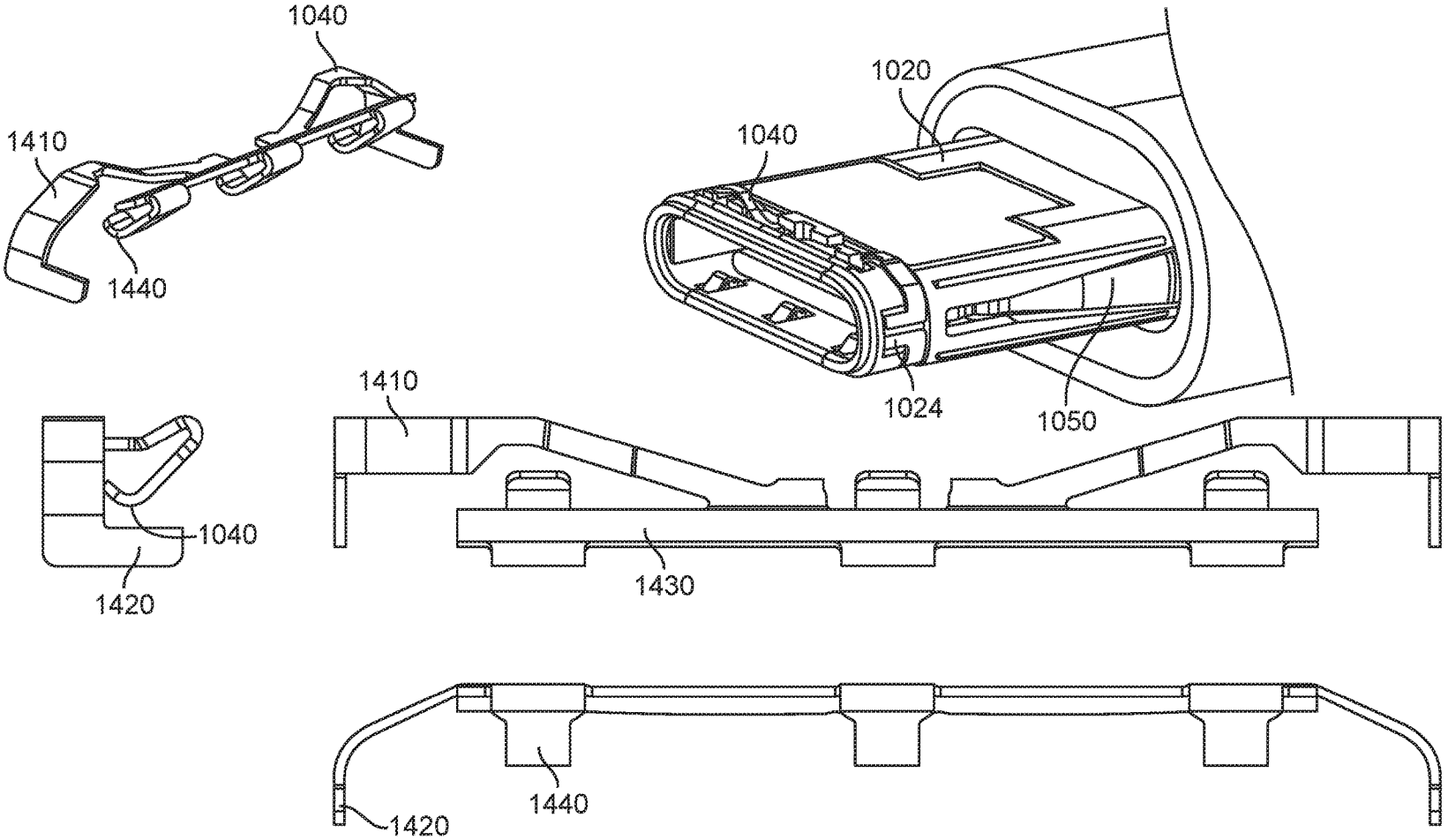
FIG. 14 illustrates a connector insert portion and a ground contact according to an embodiment of the present invention.

FIG. 14 illustrates a connector insert portion and a ground contact according to an embodiment of the present invention. This connector insert may include a housing 1020 supporting retention springs 1050 and ground contacts 1040. Ground contacts 440 may be located in slot 1024 near a front of housing 1020. Ground contacts 1040 may reduce an overall length of an insert portion of a connector insert by wrapping laterally around approximately half the circumference of housing 1020. By wrapping laterally in this way, the increase in the overall length of the insert portion caused by the inclusion of the ground contacts 1040 is limited.

Ground contacts 1040 may include contacting portions 1440, which may be joined by crosspiece 1430. Crosspiece 1430 may be held in place by supporting structures 1410. Supporting structures 1410 may include tabs 1420 for holding ground contacts 1040 securely in place in grove 1024 in housing 1020. Ground contacts 1040 may also connect to an inside of shield 1010.

Again, a tape or other insulating layer 1060 may be placed between contacts 1030 and shield 1010 to prevent contacts 1030 from contacting shield 1010. Insulating or tape layer 1060 may be attached to housing 1020. When housing 1020 is inserted into shield 1010, care should be taken to avoid having shield 1020 strip away insulating or tape layer 1060. Accordingly, embodiments of the present invention may arrange housing 1020 to protect the tape or insulating layer 1060 during insertion of housing 1020 into shield 1010. An example is shown in the following figure.

Figure 15:
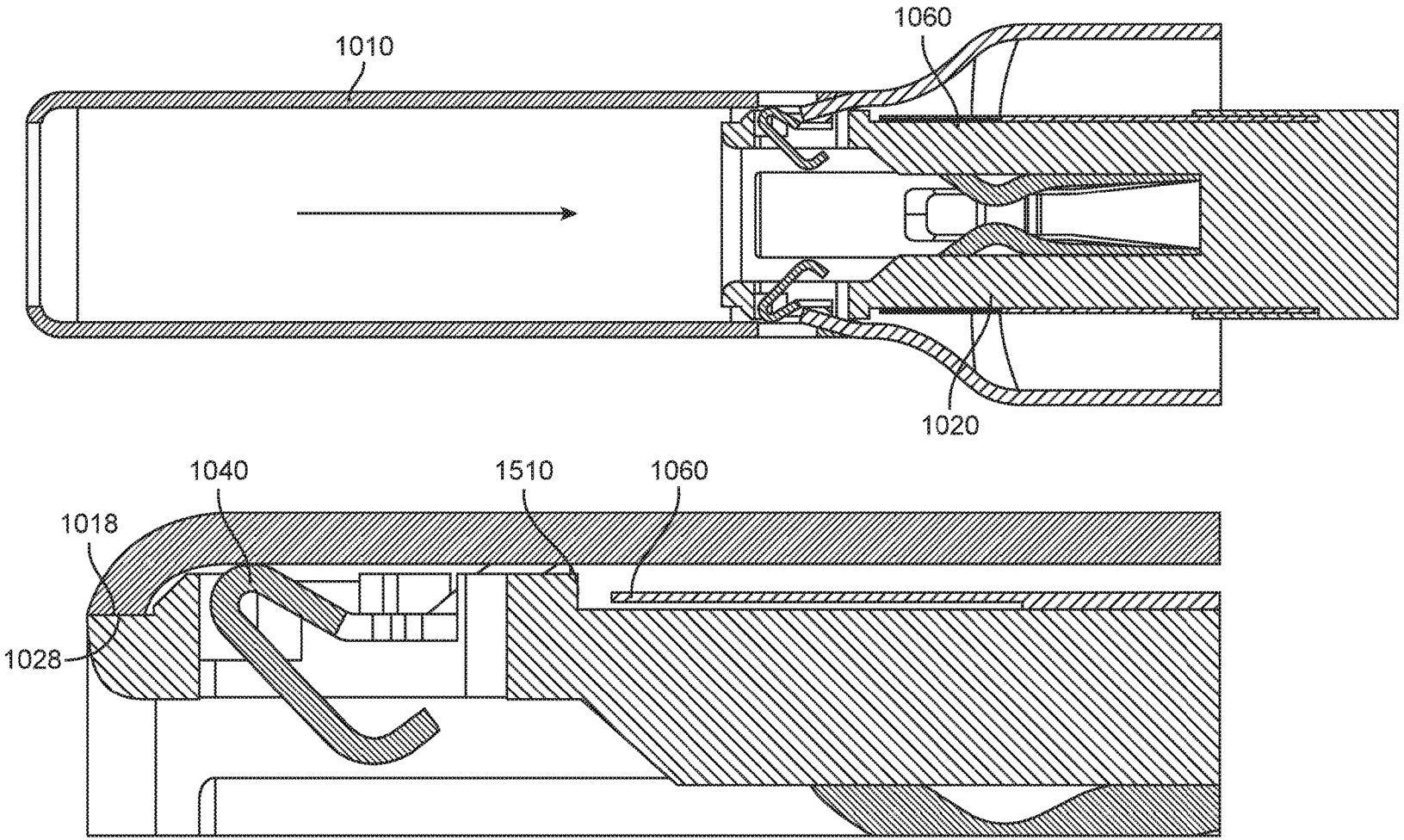
FIG. 15 illustrates steps in the manufacturing of a connector insert according to an embodiment of the present invention.

FIG. 15 illustrates steps in the manufacturing of a connector insert according to an embodiment of the present invention. In this figure, housing 1020 is shown being inserted into shield 1010. Insulating or tape layer 1060 may be located on top and bottom surfaces of housing 1020. Housing 1020 may include notch portion 1510. Notch portion 1510 may provide a space for tape 1060 to be placed such that it is not peeled away by shield 1010 when housing 1020 is inserted into shield 1010.

Again, the connector insert may include a front lip having outside portion formed by shield 1010 and an inside portion formed by housing 1020. Accordingly, shield 1010 may include a surface 1018 to engage surface 1028 of housing 1080. This connector insert may also include ground contact 1040.

In various embodiments of the present invention, signal contacts 1030 may be pre-biased in a way that results in a force being exerted at the opening of a connector insert. This force may be in a direction that tends to close the connector insert opening. This may result in a connector receptacle tongue being damaged during the insertion of the connector insert into a connector receptacle. Accordingly, embodiments of the present invention may provide manufacturing steps to avoid or mitigate this problem. An example is shown in the following figures.

Figure 16:
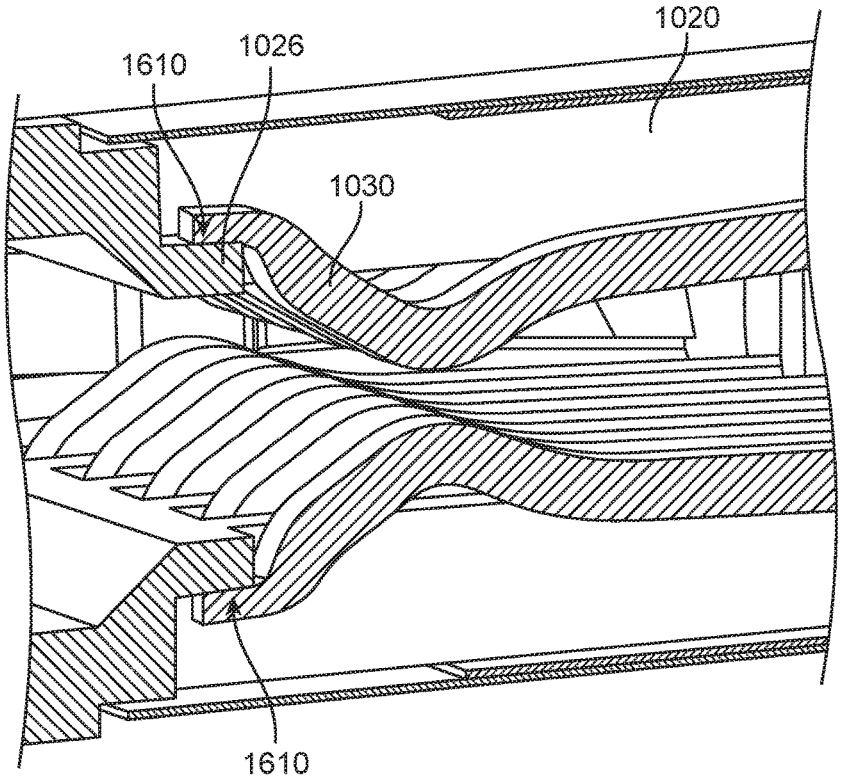
FIG. 16 illustrates forces being exerted at a connector insert opening according to an embodiment of the present invention.

FIG. 16 illustrates forces being exerted at a connector insert opening according to an embodiment of the present invention. Contacts 1030 may be located in housing 1020. Contacts 1030 may be pre-biased to exert a force on contacts on a tongue of a connector receptacle when the connector insert is inserted into the connector receptacle. This pre-bias may cause contacts 1030 to exert a force on housing portion 1026. This force may act to close a front opening of the connector insert. Accordingly, embodiments of the present invention may provide an end cap that may be inserted into the front opening of a connector insert during manufacturing. An example is shown in the following figure.

Figure 17A:
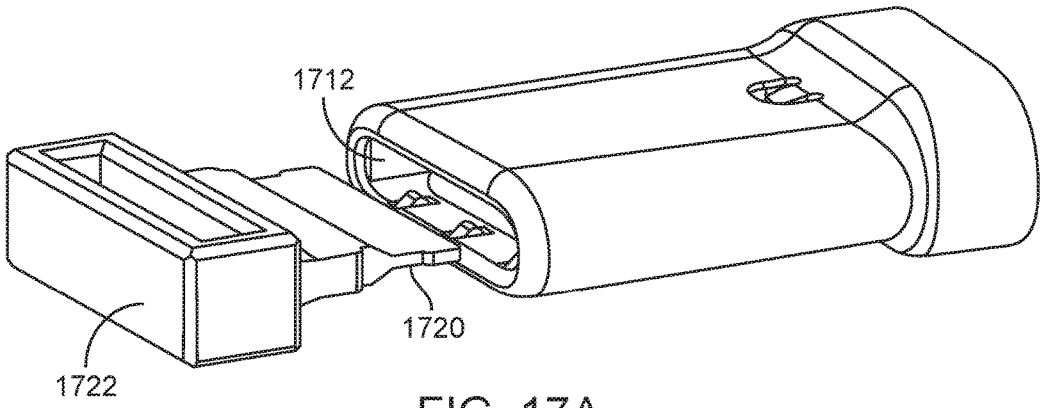
FIGS. 17A-17B illustrate an end cap being inserted into an opening of a connector insert according to an embodiment of the present invention.
Figure 17B:
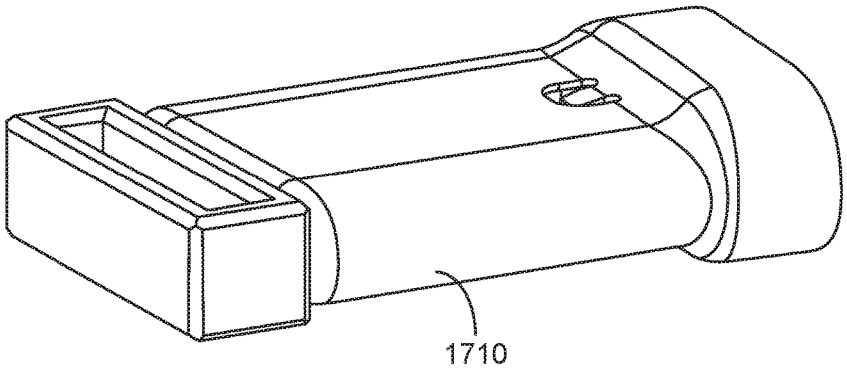

FIGS. 17A-17B illustrate an end cap being inserted into an opening of a connector insert according to an embodiment of the present invention. End cap 1720 may have a handle portion 1722 that may be grasped by an operator during assembly. The operation of end cap 1720 is shown in the following figure.

Figure 18:
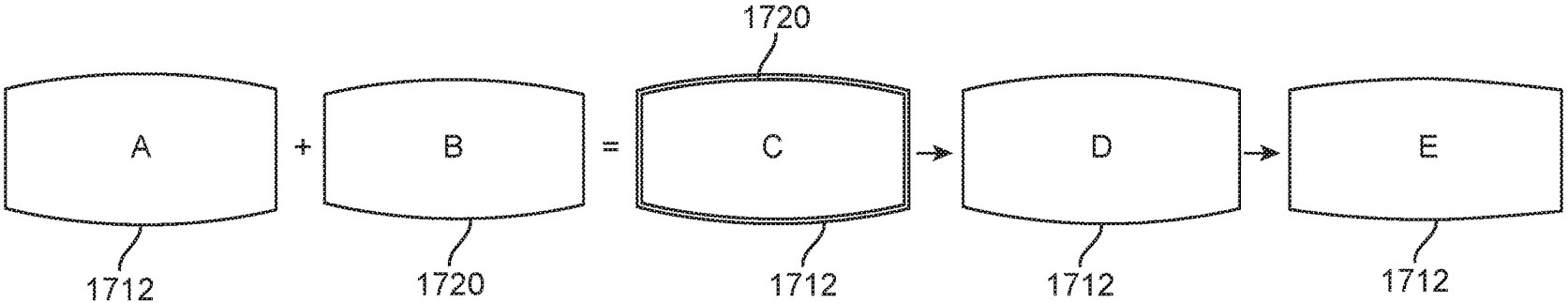
FIG. 18 illustrates the operation of an end cap that may be employed during manufacturing of a connector insert according to an embodiment of the present invention.

FIG. 18 illustrates the operation of an end cap that may be employed during manufacturing of a connector insert according to an embodiment of the present invention. State A illustrates an opening 1712 of a connector insert. Opening 1712 may have top and bottom sides biased outwardly to create compensate for forces that will be applied by contacts 1030 as shown above. Similarly, end cap 1920 may have top and bottom sides that are bowed or biased outwardly as well, as shown in stage B. End cap 1920 may be inserted into opening 1912 in stage C. At this time, the connector insert may be subjected to a high-temperature process, such as a reflow process. Ordinarily, this heating could cause the opening to droop and close. Instead, the outward shape may provide an arch of support to maintain the shape of the opening and keep it from closing. At stage D, end cap 1920 may be removed. After some time, stage E may be reached.

At this stage, the top and bottom sides of opening 1912 may remain either straight or partially outwardly bowed.

In various embodiments of the present invention, contacts and other conductive portions of connector inserts and receptacles may be formed by stamping, metal-injection molding, machining, micro-machining, 3-D printing, forging, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

a housing having front opening, a first side opening along a right side, a second side opening along a left side, a first plurality of slots along a top side, and a second plurality of slots along a bottom side;

a first plurality of contacts in the first plurality of slots in the housing;

a second plurality of contacts in the second plurality of slots in the housing;

a first retention spring in the first side opening in the housing, the first retention spring having a first length and including a contacting portion at a first end to engage a notch on a tongue of a connector receptacle;

a second retention spring in the second side opening in the housing, the second retention spring having the first length and including a contacting portion at a first end to engage a notch on a tongue of a connector receptacle; and a shield over the housing, the first retention spring, and the second retention spring, the shield contacting the first retention spring and the second retention spring when the connector insert is inserted into a connector receptacle.

2. The connector insert of claim 1 wherein the shield contacts the first retention spring and the second retention spring before the connector insert is inserted into a connector receptacle.

3. The connector insert of claim 1 wherein the first retention spring further comprises a dimple, and a portion of the first retention spring from the dimple to the contacting portion forms a deflection arm that deflects as the connector insert is inserted into a connector receptacle.

4. The connector insert of claim 3 wherein the deflection arm has a length that is a majority of the first length.

5. The connector insert of claim 3 wherein the deflection arm has a length that is greater than one-half of the first length.

6. The connector insert of claim 1 further comprising a first insulating layer between the first plurality of contacts and the shield and a second insulating layer between the second plurality of contacts and the shield.

7. The connector insert of claim 6 wherein the first insulating layer and the second insulating layer are pieces of tape.

8. The connector insert of claim 1 wherein the connector insert has a front lip around the front opening of the housing, wherein an inside portion of the lip is formed by the housing and an outside portion of the lip is formed by the shield.

9. The connector insert of claim 1 further comprising a first ground contact between the front opening of the housing and the first plurality of contacts and a second ground contact between the front opening of the housing and the second plurality of contacts.

10. The connector insert of claim 9 wherein the first and second ground contacts each include a plurality of contacting portions joined by a cross beam, the cross beam attached to a first lateral support structure and a second lateral support structure, wherein the first lateral support structure and a second lateral support structure wrap around approximately one-half of a circumference of the housing in a lateral direction along the front opening of the housing.

11. A connector insert comprising:

a housing having front opening, a first side opening along a right side, a second side opening along a left side, a first plurality of slots along a top side, and a second plurality of slots along a bottom side;

a first plurality of contacts in the first plurality of slots in the housing;

a second plurality of contacts in the second plurality of slots in the housing;

a first retention spring in the first side opening in the housing;

a second retention spring in the second side opening in the housing;

a first ground contact between the front opening and the first plurality of contacts;

a second ground contact between the front opening and the second plurality of contacts, wherein the first and second ground contacts each include a plurality of contacting portions joined by a cross beam, the cross beam attached to a first lateral support structure and a second lateral support structure; and a shield over the housing, the first retention spring, and the second retention spring.

12. The connector insert of claim 11 wherein the first lateral support structure and a second lateral support structure wrap around approximately one-half of a circumference of the housing in a lateral direction along the front opening of the housing.

13. The connector insert of claim 11 further comprising a first insulating layer between the first plurality of contacts and the shield and a second insulating layer between the second plurality of contacts and the shield.

14. The connector insert of claim 11 wherein the first retention spring and the second retention spring each has a first length and includes a contacting portion at a first end to engage a notch on a tongue of a connector receptacle, where each retention spring further includes a dimple, the dimple contacting the shield when the connector insert is inserted into a connector receptacle.

15. The connector insert of claim 14 wherein the shield contacts the dimple on the first retention spring and the dimple on the second retention spring before the connector insert is inserted into a connector receptacle.

16. The connector insert of claim 11 wherein the connector insert has a front lip around the front opening of the housing, wherein an inside portion of the lip is formed by the housing and an outside portion of the lip is formed by the shield.

17. The connector insert of claim 11 wherein the shield contacts the first retention spring and the second retention spring when the connector insert is inserted into a connector receptacle.

18. A connector insert comprising:

a housing having front opening, a first side opening along a right side, a second side opening along a left side, a first plurality of slots along a top side, and a second plurality of slots along a bottom side;

a first plurality of contacts in the first plurality of slots in the housing;

a second plurality of contacts in the second plurality of slots in the housing;

a first retention spring in the first side opening in the housing;

a second retention spring in the second side opening in the housing;

a first ground contact between the front opening of the housing and the first plurality of contacts;

a second ground contact between the front opening of the housing and the second plurality of contacts; and a shield over the housing, the first retention spring, and the second retention spring, the first ground contact and the second ground contact, wherein the connector insert has a front lip around the front opening of the housing, wherein an inside portion of the lip is formed by the housing and an outside portion of the lip is formed by the shield.

19. The connector insert of claim 18 wherein the first and second ground contacts each include a plurality of contacting portions joined by a cross beam, the cross beam attached to a first lateral support structure and a second lateral support structure, wherein the first lateral support structure and a second lateral support structure wrap around approximately one-half of a circumference of the housing in a lateral direction along the front opening of the housing.

20. The connector insert of claim 19 wherein the shield contacts the first retention spring and the second retention spring when the connector insert is inserted into a connector receptacle.

* * * * *